US010421078B2

(12) United States Patent
Nydam et al.

(10) Patent No.: US 10,421,078 B2
(45) Date of Patent: Sep. 24, 2019

(54) TWO-DIMENSIONAL CUTTING FEATURES

(71) Applicant: JWC ENVIRONMENTAL, LLC, Costa Mesa, CA (US)

(72) Inventors: Todd Nydam, Newport Beach, CA (US); Corey Glauberman, Tustin, CA (US); Daniel McHugh, New Prague, MN (US); Rob Sabol, Aliso Viejo, CA (US)

(73) Assignee: JWC Environmental, LLC, Santa Ana, CA (US)

( * ) Notice: Subject to any disclaimer, the term of this patent is extended or adjusted under 35 U.S.C. 154(b) by 539 days.

(21) Appl. No.: 14/862,247

(22) Filed: Sep. 23, 2015

(65) Prior Publication Data

US 2016/0082443 A1 Mar. 24, 2016

Related U.S. Application Data

(60) Provisional application No. 62/054,628, filed on Sep. 24, 2014.

(51) Int. Cl.

| | |
|---|---|
| ***B02C 18/00*** | (2006.01) |
| ***B02C 18/14*** | (2006.01) |
| ***B02C 18/16*** | (2006.01) |
| ***B02C 18/18*** | (2006.01) |

(52) U.S. Cl.

CPC ..... *B02C 18/0092* (2013.01); *B02C 18/142* (2013.01); *B02C 18/16* (2013.01); *B02C 18/182* (2013.01)

(58) Field of Classification Search

CPC . B02C 18/0092; B02C 18/182; B02C 18/142; B02C 18/16

USPC ..... 241/236

See application file for complete search history.

(56) References Cited

U.S. PATENT DOCUMENTS

| | | | | |
|---|---|---|---|---|
| 4,046,324 A * | 9/1977 | Chambers | B02C 18/0092 | 241/236 |
| 4,669,673 A * | 6/1987 | Lodovico | B02C 19/0081 | 241/158 |
| 5,048,764 A * | 9/1991 | Flament | B02C 18/0092 | 241/222 |
| 6,343,755 B1 * | 2/2002 | Barclay | B02C 18/142 | 241/236 |

(Continued)

FOREIGN PATENT DOCUMENTS

GB 661443 A * 11/1951 ..... B02C 18/0092

*Primary Examiner* — Faye Francis

(74) *Attorney, Agent, or Firm* — Sughrue Mion, PLLC

(57) ABSTRACT

An apparatus for comminuting solid waste material including a casing defining a comminution chamber and being open on opposite sides thereof for permitting the flow of liquid therethrough. The apparatus including cooperating substantially parallel first and second shafts, each including a plurality of cutting elements mounted on said first shaft in interspaced relationship with a plurality of second cutting elements mounted on said second shaft, each of said cutting elements having at least one cutting tooth thereon, said cutting elements being positioned between and separated in an axial direction by spacers which are coplanar with the cutting elements of the adjacent stack such that a cutting element from one stack and a spacer from the other stack form a pair of interactive shredding members, wherein the spacers have a textured or scalloped outer cylindrical surface.

15 Claims, 8 Drawing Sheets

(56) References Cited

U.S. PATENT DOCUMENTS

| | | | | |
|---|---|---|---|---|
| 6,616,077 | B2 * | 9/2003 | Koenig | B02C 18/142<br>241/230 |
| 7,172,147 | B2 * | 2/2007 | Diemunsch | B02C 18/184<br>241/236 |
| 7,533,839 | B2 * | 5/2009 | Wang | B02C 18/0007<br>241/236 |
| 7,658,343 | B2 * | 2/2010 | Potts | B02C 4/18<br>241/158 |
| 7,789,334 | B2 * | 9/2010 | Wada | B02C 18/142<br>241/166 |
| 8,128,013 | B2 * | 3/2012 | Bartelt | B02C 18/142<br>241/236 |
| 8,157,014 | B2 * | 4/2012 | Hariharan | E21B 21/066<br>166/357 |
| 2005/0263633 | A1 * | 12/2005 | Vantrease | B02C 18/142<br>241/236 |

* cited by examiner

DETAIL A

DETAIL B

DETAIL C

DETAIL D

DETAIL E

TWO-DIMENSIONAL CUTTING FEATURES

CROSS-REFERENCE TO RELATED PATENT APPLICATIONS

This application claims the benefit of U.S. Provisional Patent Application No. 62/054,628 filed on Sep. 24, 2014 in the U.S. Patent Trademark Office, the disclosure of which is incorporated herein in its entirety by reference.

BACKGROUND OF THE INVENTION

1. Field of the Invention

Twin-shafted grinders are commonly used for particle size reduction of solids in various municipal wastewater applications. Cutters separated by spacers stacked on counter-rotating shafts "grind" friable materials or "shred" woven and fibrous materials that enter the sewer system either by being flushed down the toilet or by entering through storm drains on the street. The geometry of the cutters and the shaft speeds affect the particle size and throughput produced by the machine.

2. Description of the Related Art

Since the use of non-dispersible wipes (baby wipes) and other paper products started becoming more and more prevalent by consumers, they have also been disposed of in municipal wastewater. Common cutter designs and shaft speeds have proven reasonably effective at shredding sheets of woven and fibrous materials into strips; however, these strips can weave together in the waste stream causing clogged pipes and damaging downstream equipment such as lift pumps. The related art cutter geometry and shaft speeds tend to be relatively ineffective at cutting the strips of shredded material in a second dimension to consistently produce smaller particle sizes that are less like to reweave.

As the grinder operates, the tip of a cutter tooth pulls material into the cutting chamber where the material is sheared on each side of the cutter by the adjacent cutters on the opposite shaft. There is a potential for the sheared strip to get wedged between the two cutters on the opposite shaft and pack into the void around the outside of the spacer that is between those two cutters. Twin-shafted grinders commonly operate with different shaft speeds to promote a tearing action of the material at the cutter shearing surfaces, but there is a trade-off to having the different shaft speeds. While the cutter teeth on the high-speed shaft readily clean out the material between the cutters on the low-speed shaft, the cutter teeth on the low-speed shaft are often ineffective at cleaning out the material between the cutters on the high-speed shaft, and the material that is cleaned out is inconsistent in size. In addition, accelerated wear occurs on the low-speed shaft cutter teeth relative to the wear on the high-speed shaft cutter teeth because the low speed cutters are continuously rubbing against debris that is wedged between the cutters on the high speed shaft.

SUMMARY OF THE INVENTION

According to an aspect of the present invention, there is provided an apparatus for comminuting solid waste material including a casing defining a comminution chamber and being open on opposite sides thereof for permitting the flow of liquid therethrough bearing solid waste material and being adapted for connection in a solid waste disposal line. The apparatus includes a comminutor assembly including cooperating substantially parallel first and second shredding stacks.

The comminutor includes first and second parallel shafts rotatably mounted, each including a plurality of cutting elements mounted on said first shaft in interspaced relationship with a plurality of second cutting elements mounted on said second shaft, each of said cutting elements having at least one cutting tooth thereon, said cutting elements being positioned between and separated in an axial direction by spacers which are coplanar with the cutting elements of the adjacent stack such that a cutting element from one stack and a spacer from the other stack form a pair of interactive shredding members. The spacers have a textured or scalloped outer cylindrical surface.

According to another aspect, a clearance is formed between the cutter element of one stack and the spacer of the other stack that is 0.15 inches or less.

According to another aspect, the cutting elements have a plurality of cutting teeth, each cutting tooth having a land area formed on an outer diameter surface of the cutting tooth, the land area extending at least 1/16 of an inch along the circumferential direction of the cutting element.

According to another aspect, the outer cylindrical surface of the spacer is a textured surface including at least one of a diamond knurling surface, a square knurling surface, a straight knurling surface or an abrasive coating.

According to another aspect, the land area of the cutting tooth is equal to or less than a height of the cutting tooth.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
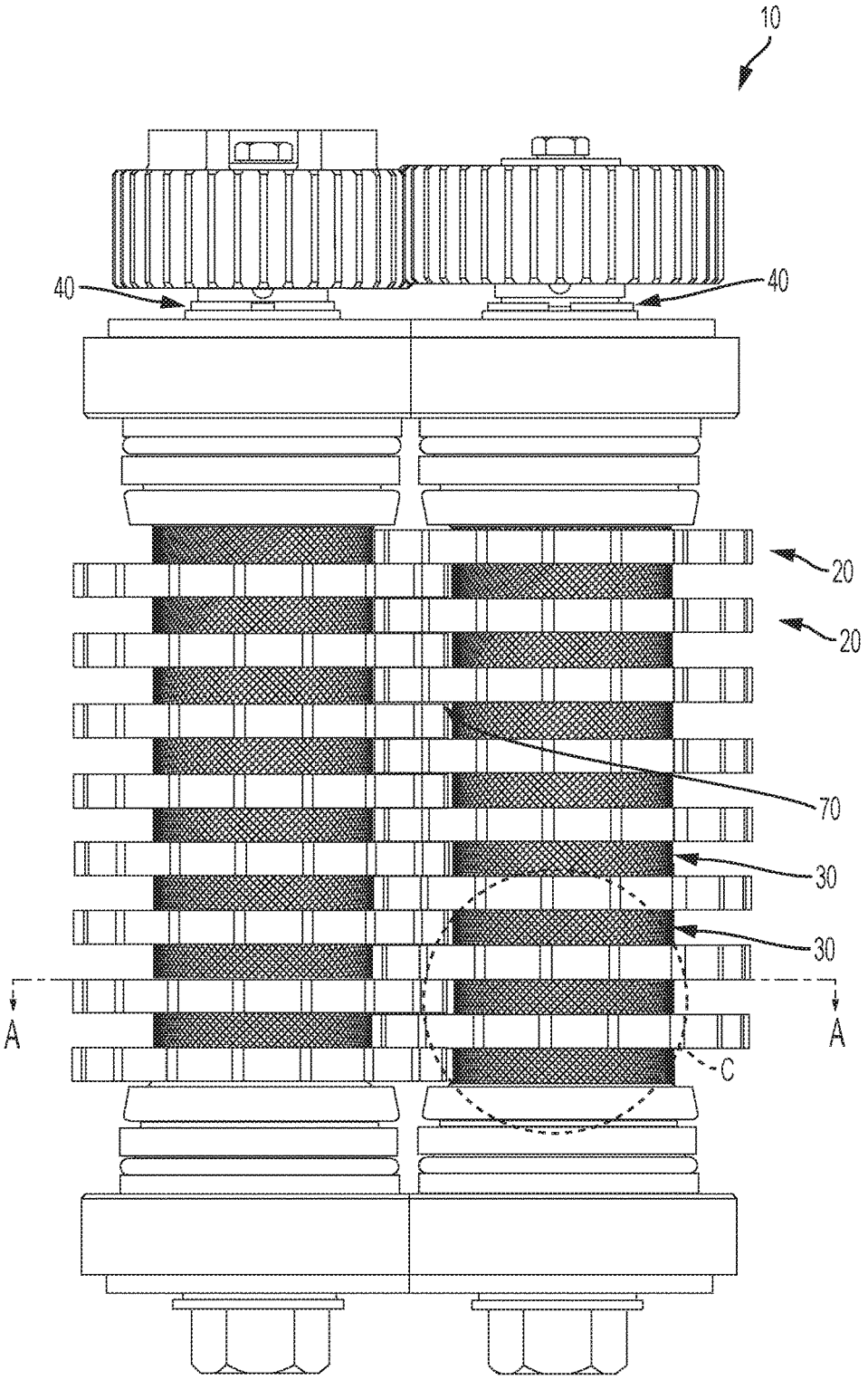
FIG. 1 illustrates an elevation view of a cutter stack showing transfer gears.
Figure 2A:
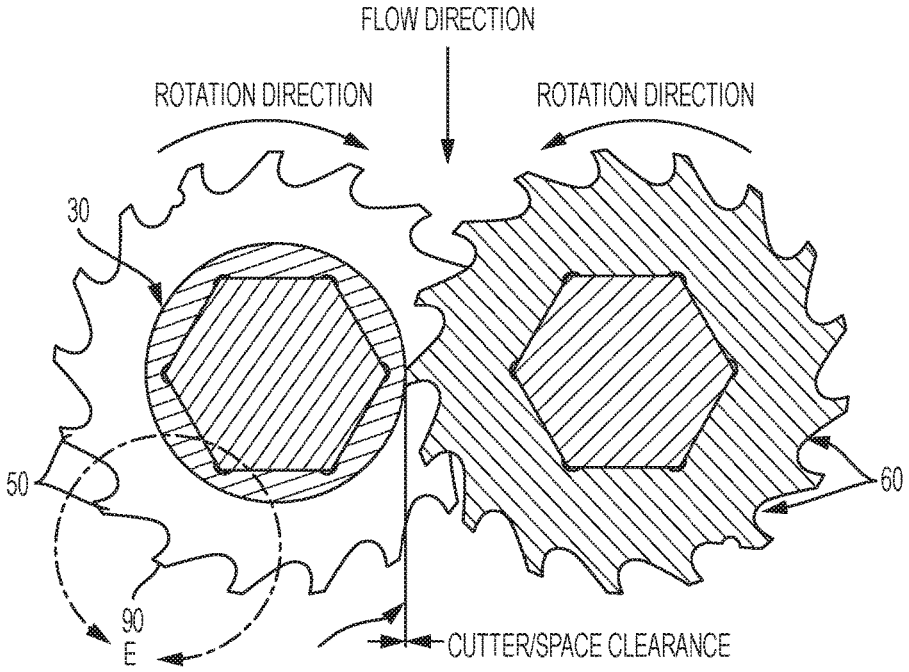
FIGS. 2A, 2B and 2C show various views of a cutter stack showing a cutter and corresponding spacer.
Figure 2B:
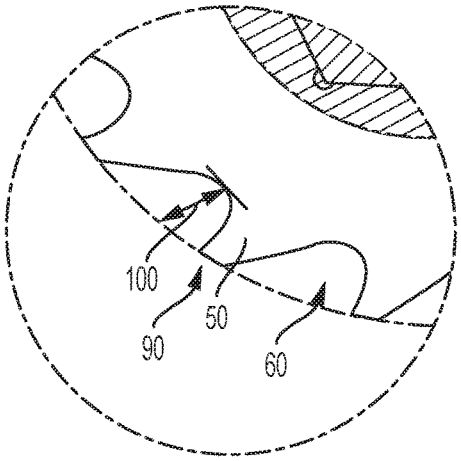
Figure 2C:
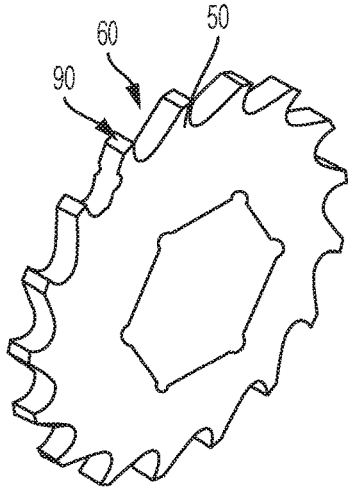

FIG. 1 shows a twin shafted grinder 10 configured to grind and shred solid materials carried in a wastewater system. As shown in the figure, a series of cutters 20 and spacers 30 are positioned in an alternating manner along each of two opposing shafts 40. The shafts 40 are driven to rotate in different directions and positioned so that a spacer 30 on one shaft 40 is positioned across from a cutter 20 on the opposing shaft 40. The rotational direction and the orientation of the twin-shafted grinder 10 with respect to the wastewater flow are shown in FIGS. 2A, 2B and 2C.

One aspect of the present application is to maintain a clean cutter stack by having the tip speed of the cutters 50 maximized relative to the surface speed of the opposing spacer 30. This allows for the tip of the cutter 50 to scrape away material from the outside diameter of the spacer 30.

An acceptable difference in relative speeds between the cutters 50 and opposing spacers 30 is achievable on both shafts 40 when the shafts 40 are rotating at near the same speed, because the diameters of the cutters 20 are great than the diameters of spacers 30. If the shafts speeds deviate from each other too much, the tip speed of the cutter 50 on the slower shaft 40 will not be fast enough relative to the surface speed of the spacer 30 on the faster shaft 40 to clean out material stuck between the cutters on the faster shaft. The optimum ratio of between the drive shaft (faster shaft) and the driven shaft (using gearing) ranges from 1.01:1 to 1.14:1. At these ratios, certain differential velocities have been found to be optimum (difference in velocity between the cutter tip and the spacer)—6.97 ft/s to 7.25 ft/s on the drive shaft cutter tip and 4.86 ft/s to 4.39 ft/s on the driven shaft cutter tip. It is noted that the diameters of the spacers and cutters on the different shafts are the same.

The second aspect of the present application is to reduce sheet material (e.g., wipes) into consistently-small particles by cutting into two dimensions. Cutting material in the first dimension and creating strips is readily accomplished by ensuring that the clearances 70 (FIG. 1) are small between opposing, adjacent counter-rotating cutters 20. Cutting strips to length (to shorten the strip) is far-more complex and requires that strips be placed in tension to tear the material at the desired length (in the absence of a mechanism to chop strips to length). During operation, after the material is sheared into strips by the opposing, adjacent cutters 20, the tip of the cutter tooth 50 continues to pull the strip to interface with the spacer 30. Tearing of the strip to the desired length occurs when there is enough drag or friction on the material between the land 90 of the cutter tooth 50 and the spacer 30 to overcome the strength of the fibers in the material.

Key factors for tearing strips to length include: clearance between the cutter and opposing spacer, the length of land 90 at the tip of the cutter tooth 50, and friction between the spacer 30 and the material to be torn to length.

The first key factor is to manage the clearance 80 between the cutter 20 (FIG. 2A) and corresponding spacer 30 in the radial direction. A pinch point can be created to get traction on the strip of material. The clearance should be 0.15" or less to create an effective pinch point.

The second key factor is for the outer profile of the cutter tooth 50 to include a short outside-diameter land 90. This land ensures that the duration of the pinch point lasts long enough to maximize the likelihood of tearing without packing material against the spacer. In a preferred embodiment the land should be not less than 1/16" and should not exceed the nominal tooth height.

Figure 3:
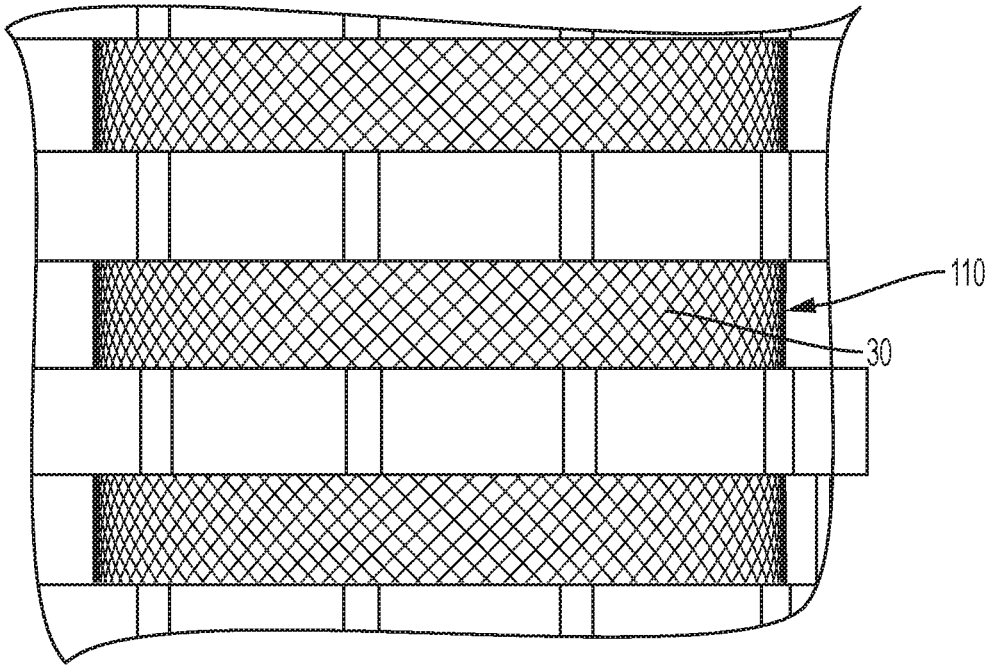
FIG. 3 is detailed view of a cutter stack showing a high-friction surface of a spacer.
Figure 4:
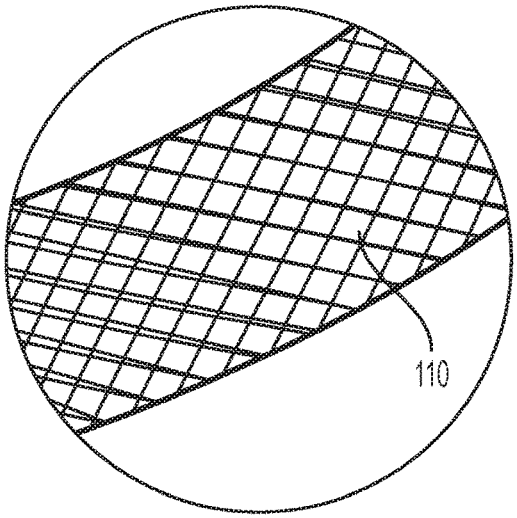
FIG. 4 is view showing a diamond knurled spacer.
Figure 4:
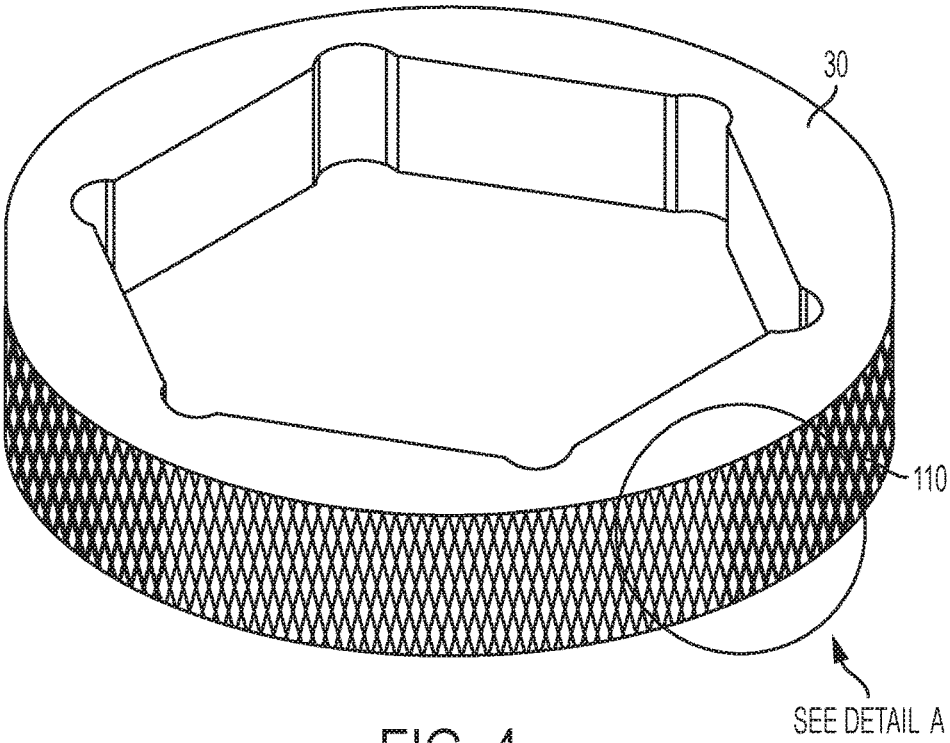
Figure 5:
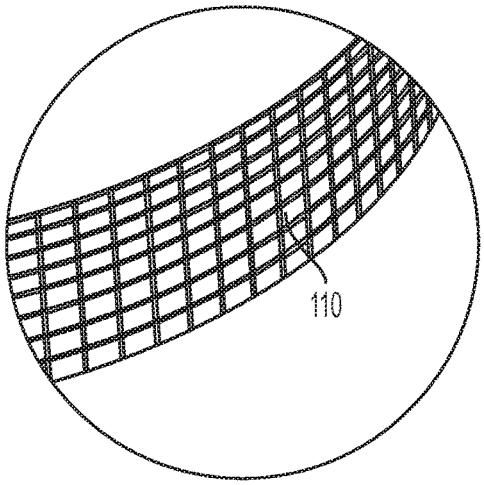
FIG. 5 is a view showing a square knurled spacer.
Figure 5:
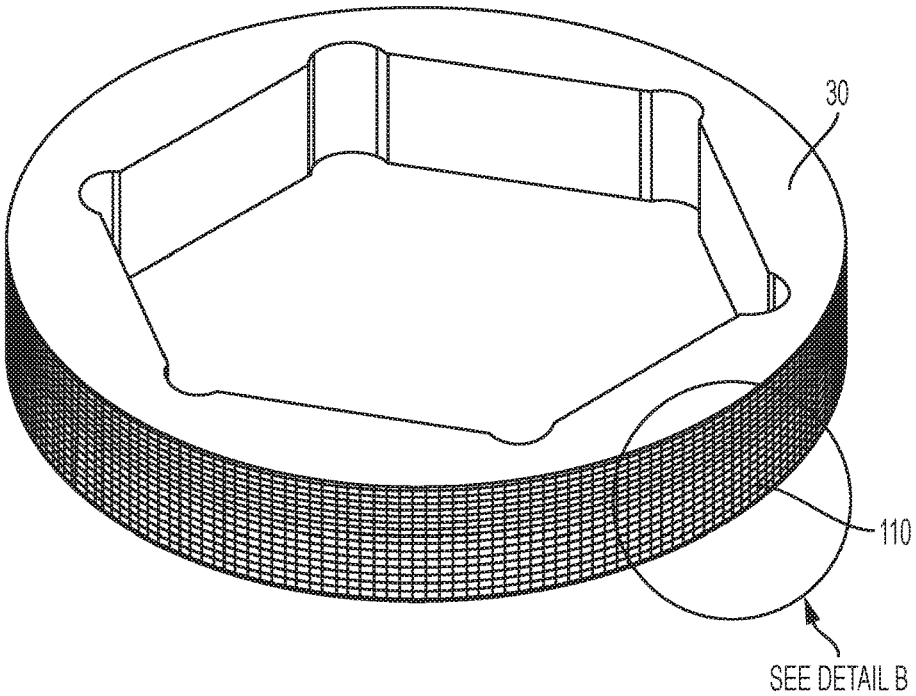
Figure 6:
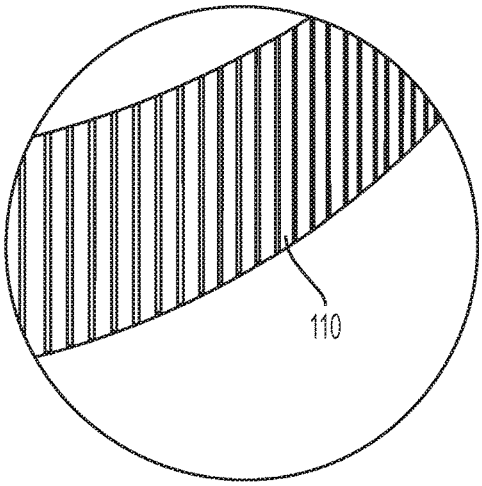
FIG. 6 is a view showing a straight knurled spacer.
Figure 6:
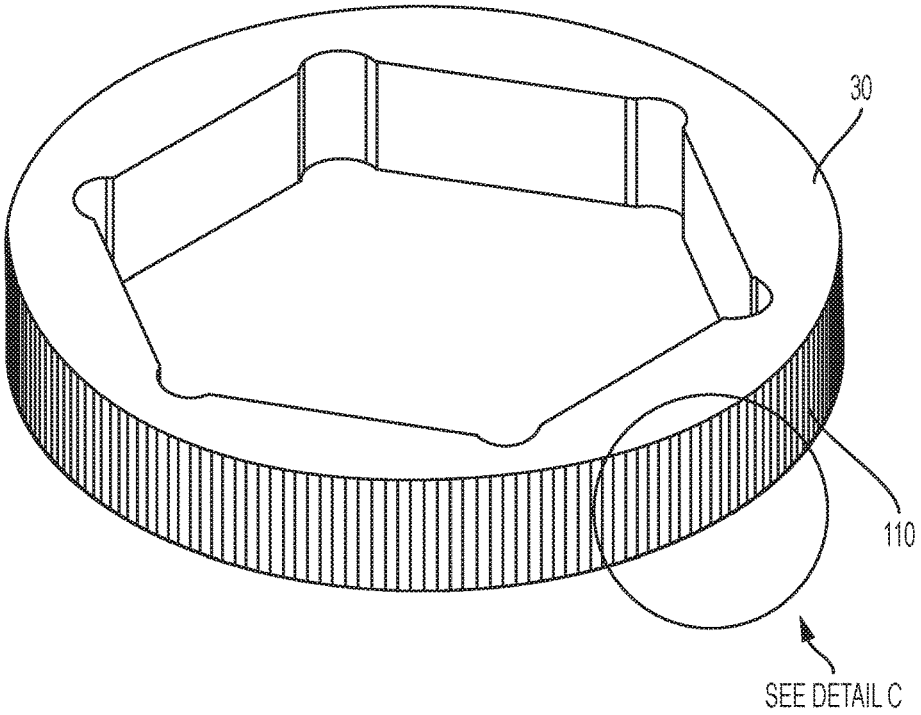
Figure 7:
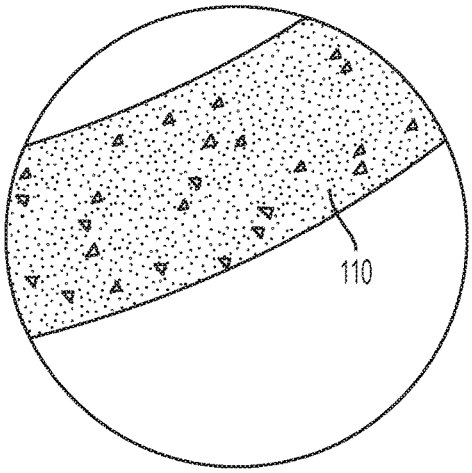
FIG. 7 is a view showing an abrasive coated spacer.
Figure 7:
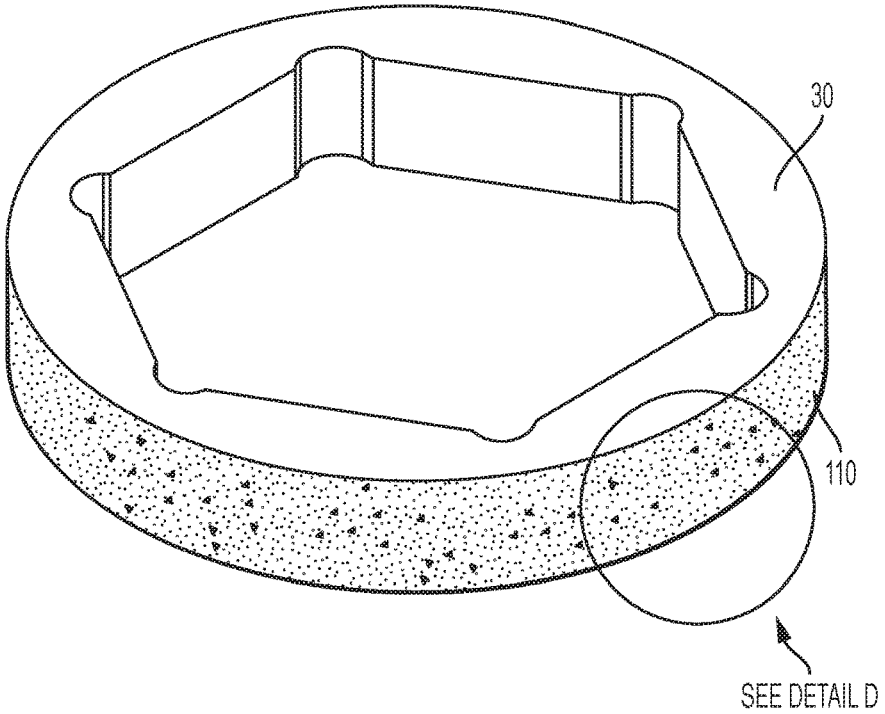
Figure 8:
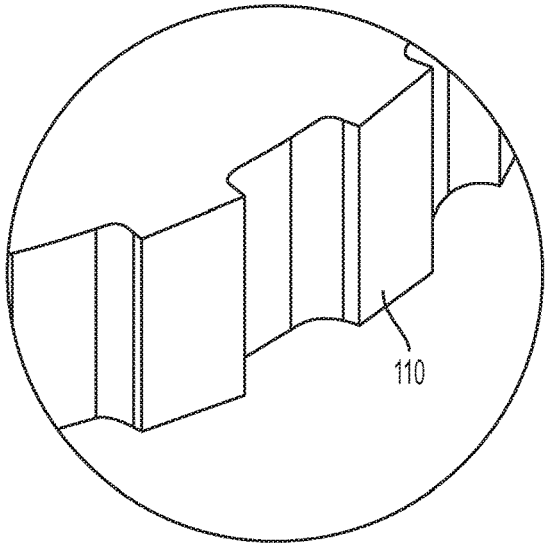
FIG. 8 is a view showing a scalloped spacer.
Figure 8:
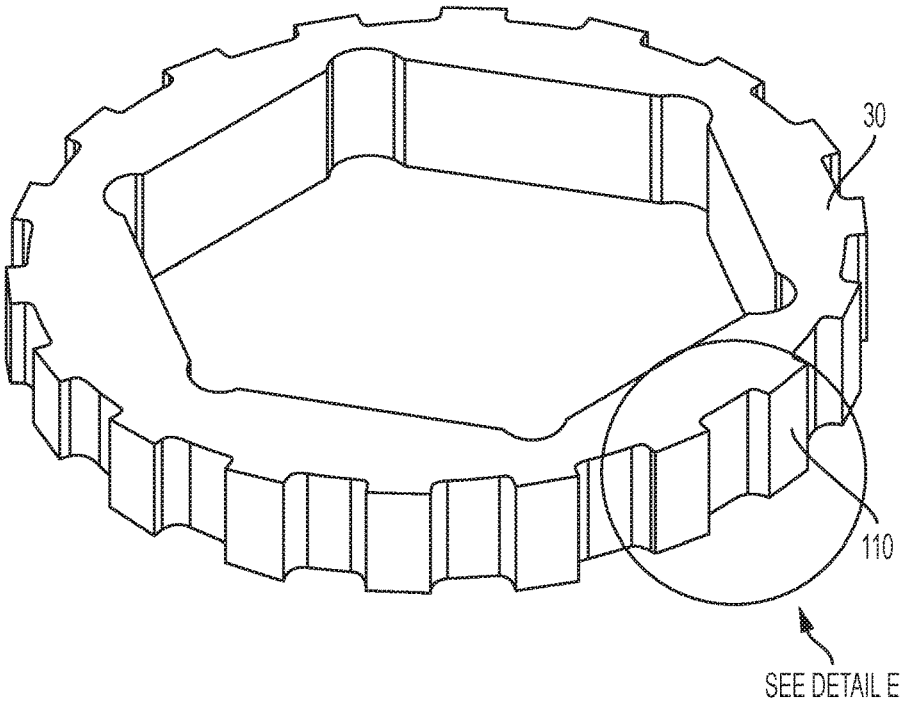

As shown in FIG. 3, the third key factor is to texture the exterior cylindrical surface 110 of the spacer to create friction. In various embodiments, the texturing includes: diamond knurling (FIG. 4); square knurling (FIG. 5); straight knurling (FIG. 6); an abrasive coating similar to sand paper that may come from an abrasive bonding process or a flame-spray coating such as alumina ceramic (FIG. 7), or a "scallop" feature (FIG. 8).

According to the structure of the present invention as described above, by controlling various factors of the twin-shafted grinder, two dimensional cutting of solid waste material can be ensured while maintaining a clean cutter stack.

What is claimed is:

1. An apparatus for comminuting solid waste material comprising:

a casing defining a comminution chamber and being open on opposite sides thereof for permitting the flow of liquid therethrough bearing solid waste material and being adapted for connection in a solid waste disposal line;

a comminutor assembly including cooperating parallel first and second shredding stacks comprising:

first and second parallel shafts rotatably mounted and including a plurality of first cutting elements mounted on said first shaft in interspaced relationship with a plurality of second cutting elements mounted on said second shaft, each of said first and second cutting elements having at least one cutting tooth thereon, said first cutting elements being interspaced with said second cutting elements, each of the first cutting elements being positioned between and separated in an axial direction by spacers on the first parallel shaft, and each of the second cutting elements being separated in an axial direction by spacers on the second parallel shaft, the spacers on the first parallel shaft being coplanar with a corresponding one of the second cutting elements on the second parallel shaft, the spacers on the second parallel shaft being coplanar with a corresponding one of the first cutting elements on the first parallel shaft such each coplanar spacer and cutting element form a pair of interactive shredding members, wherein an outer cylindrical surface of each of the spacers has a textured or scalloped outer cylindrical surface.

2. The apparatus for comminuting solid waste material according to claim 1, wherein a clearance is formed between the corresponding cutting element of one stack and the corresponding spacer of the other stack is 0.15 inches or less.

3. The apparatus for comminuting solid waste material according to claim 1, wherein each of the first and second cutting elements have a plurality of cutting teeth, each cutting tooth having a land area formed on an outer diameter surface of the cutting tooth, the land area extending at least 1/16 of an inch along a circumferential direction of each of the first and second cutting elements.

4. The apparatus for comminuting solid waste material claim 1, wherein the outer cylindrical surface is a textured surface including at least one of a diamond knurling surface, a square knurling surface, a straight knurling surface or an abrasive coating.

5. The apparatus for comminuting solid waste material claim 3, wherein the land area is equal to or less than a height of the cutting tooth.

6. The apparatus for comminuting solid waste material according to claim 2, wherein each of the first and second cutting elements have a plurality of cutting teeth, each cutting tooth having a land area formed on an outer diameter surface of the cutting tooth, the land area extending at least 1/16 of an inch along the circumferential direction of each of the first and second cutting elements.

7. The apparatus for comminuting solid waste material claim 2, wherein the outer cylindrical surface is a textured surface including at least one of a diamond knurling surface, a square knurling surface, a straight knurling surface or an abrasive coating.

8. The apparatus for comminuting solid waste material claim 6, wherein the land area is equal to or less than a height of the cutting tooth.

9. The apparatus for comminuting solid waste material according to claim 1, wherein the ratio of revolution per minute of the first parallel shaft to the second parallel is in the range of 1.01:1 to 1.14:1, inclusive.

10. The apparatus for comminuting solid waste material according to claim 9, wherein each of the first and second cutting elements have a plurality of cutting teeth, each cutting tooth having a land area formed on an outer diameter surface of the cutting tooth, the land area extending at least 1/16 of an inch along the circumferential direction of each of the first and second cutting elements.

11. An apparatus for comminuting solid waste material comprising:

a casing defining a comminution chamber and being open on opposite sides thereof for permitting the flow of liquid therethrough bearing solid waste material and being adapted for connection in a solid waste disposal line;

a comminutor assembly including cooperating parallel first and second shredding stacks comprising:

first and second parallel shafts rotatably mounted and including a plurality of first cutting elements mounted on said first shaft in interspaced relationship with a plurality of second cutting elements mounted on said second shaft, each of said first and second cutting elements having at least one cutting tooth thereon, said first cutting elements being interspaced with said second cutting elements, each of the first cutting elements being positioned between and separated in an axial direction by spacers on the first parallel shaft, and each of the second cutting elements being separated in an axial direction by spacers on the second parallel shaft, the spacers on the first parallel shaft being coplanar with a corresponding one of the second cutting elements on the second parallel shaft, the spacers on the second parallel shaft being coplanar with a corresponding one of the first cutting elements on the first parallel shaft such each coplanar spacer and cutting element form a pair of interacting shredding members, wherein a clearance is formed between the first cutting elements or the second cutting elements and the coplanar spacer of the other stack is 0.15 inches or less, wherein the spacers have a textured or scalloped outer cylindrical surface.

12. The apparatus for comminuting solid waste material according to claim 11, wherein each of the first and second cutting elements have a plurality of cutting teeth, each cutting tooth having a land area formed on an outer diameter surface of the cutting tooth, the land area extending at least 1/16 of an inch along a circumferential direction of each of the first and second cutting elements.

13. The apparatus for comminuting solid waste material according to claim 12, wherein the land area is equal to or less than a height of the cutting tooth.

14. The apparatus for comminuting solid waste material according to claim 12, wherein a clearance is formed between the corresponding cutting element of one stack and the corresponding spacer of the other stack is 0.15 inches or less, wherein the land area is equal to or less than a height of the cutting tooth.

15. The apparatus for comminuting solid waste material according to claim 11, wherein the outer cylindrical surface is a textured surface including at least one of a diamond knurling surface, a square knurling surface, a straight knurling surface or an abrasive coating.

* * * * *